United States Patent [19]

Baczek et al.

[11] 4,272,560

[45] Jun. 9, 1981

[54] METHOD OF DEPOSITING CATION EXCHANGE MEMBRANE ON A FORAMINOUS CATHODE

[75] Inventors: Stanley K. Baczek; G. Howard McCain, both of Painesville, Ohio

[73] Assignee: Diamond Shamrock Corporation, Dallas, Tex.

[21] Appl. No.: 87,332

[22] Filed: Oct. 23, 1979

[51] Int. Cl.[3] ..... B05D 5/12

[52] U.S. Cl. ..... 427/58; 204/296; 260/33.8 F; 427/388.1; 427/385.5; 427/115

[58] Field of Search ..... 427/58, 388.1, 385; 204/296; 260/33.8 F

[56] References Cited

U.S. PATENT DOCUMENTS

| | | | |
|---|---|---|---|
| 3,718,627 | 2/1973 | Grot | 204/296 X |
| 3,852,135 | 12/1974 | Cook et al. | 204/296 X |
| 4,028,324 | 6/1977 | Tuschner | 260/33.8 F |
| 4,065,366 | 12/1977 | Oda et al. | 204/296 X |
| 4,168,216 | 9/1979 | Burkhardt et al. | 204/296 X |
| 4,176,215 | 11/1979 | Molnar et al. | 204/296 X |
| 4,182,670 | 1/1980 | Argade et al. | 204/295 X |
| 4,189,369 | 2/1980 | Fang | 204/296 |

*Primary Examiner*—Shrive P. Beck
*Attorney, Agent, or Firm*—John P. Hazzard

[57] ABSTRACT

Normally solid copolymers of a fluorinated vinyl monomer and a perfluorinated vinyl compound having a carboxyl and/or sulfonyl group attached directly to the perfluorinated vinyl group or indirectly through an alkyl or ether linkage have been found to be soluble in low molecular weight polymers of perhalogenated alkyl ethers, low molecular weight polymers of perhalogenated alkyls and perfluoro kerosenes, each of said solvent materials having boiling points between about 200° C. and 350° C. The copolymeric material dissolved in accordance with the instant invention can readily be resolidified by solvent removal and hydrolyzed or converted to the salt form to become a cation exchange material having an equivalent weight in the range of 1000 to 1600.

Membrane coated cathodes can be formed using the dissolved copolymeric material and may be made by casting or coating a foraminous cathode followed by removal of the solvent to result in a continuous, pore-free coating of membrane on the cathode. Multiple coatings or other techniques can be used to build up the desired thickness of the membrane. Reinforced membrane may be produced by similar manufacturing techniques wherein the casting or coating of the membrane is upon a reinforcing backing fabric, which can be polytetrafluoroethylene mesh or the like is first wrapped around the foraminous cathode. The copolymeric material which is used in making the membrane coated cathode can be a single material or it can be of various equivalent weights, structures (carboxyl or sulfonyl, mixtures of same, or can be layers of the same or different materials).

7 Claims, No Drawings

METHOD OF DEPOSITING CATION EXCHANGE MEMBRANE ON A FORAMINOUS CATHODE

BACKGROUND OF THE INVENTION

This invention relates to improved methods for the production of foraminous cathodes having a continuous coating of cation exchange copolymers, reinforced and unreinforced, useful as separators in batteries and fuel cells as well as electrochemical cells such as chlor-alkali cells.

Typical of the cation exchange copolymers involved in the instant invention are the fluorocarbon vinyl ether polymers disclosed in U.S. Pat. No. 3,282,875. This patent discloses the copolymerization of fluorocarbon vinyl ethers having sulfonyl groups attached thereto with fluorinated vinyl compounds. Of the various copolymers listed in U.S. Pat. No. 3,282,875 is the copolymer produced by the copolymerization of tetrafluoroethylene with perfluoro(3,6-dioxa-4-methyl-7-octene sulfonyl fluoride). This is the base copolymer from which most of the membranes in commercial use today are made from.

Another example of cation exchange resins useful in the instant invention are those described in U.S. Pat. No. 3,718,627. The disclosed ion exchange resins are copolymers of tetrafluoroethylene and compounds of the formula $CF_2=CF(CF_2)_nSO_2F$.

After polymerization of either of these materials of the prior art, the copolymer must be hydrolyzed to obtain its ion exchange character. Typically, such materials are treated with caustic to convert the sulfonyl halide group to the alkali metal salt thereof.

These known perfluorocarbon-type cation exchange membranes containing only sulfonic acid groups, however, have been found to have a disadvantage that when used in the electrolysis of an aqueous solution of an alkali metal halide, they tend to permit penetration there through of excessive hydroxyl ions by back migration from the cathode compartment because of the high hydrophilicity of the sulfonic acid group. As a result, the current efficiency during electrolysis at higher caustic concentrations is lower. At extremely high caustic concentrations, the process becomes economically disadvantageous compared to other methods of electrolysis of sodium chloride solutions, such as the mercury or diaphragm process. Many attempts have been made to avoid this disadvantage of lower current efficiency by a number of means. Initially, people in the art attempted to utilize membrane containing less sulfonic acid groups, or expressed in another manner, membrane material having a higher equivalent weight. Such lowering of the sulfonic acid group concentration or the increase of the equivalent weight of the membrane does indeed limit the back migration of hydroxyl ions, but results in a serious decrease in the electroconductivity of the membrane and thus, a proportional increase in the power consumption is noted.

A number of solutions of this problem have been attempted in the prior art. Typical of such attempts is the surface modification of the membrane material of the cathode side to attempt to minimize back migration of hydroxyl ions. One such attempt was to laminate to the surface of a membrane of low equivalent weight a thin surface layer of material having a higher equivalent weight so as to minimize back migration. This attempt has not been successful due to the fact that such laminated membranes do not joint together well and in operation tend to separate and, in extreme cases, rupture. The laminating technique itself puts much stress on the copolymeric materials in that higher temperatures are required in the calendering of the melt processable copolymer to thin sheets. While the copolymeric material is melt processable, the temperatures at which it flows are very close to the temperatures at which degradation can take place. Thus, melt processable fabrication methods must be tightly controlled and are at best difficult.

Later attempts to improve membrane cells by reducing hydroxyl back migration in, for example, chlor-alkali cells, was to treat the cathode surface of the membrane with an amine whether mono- or diamine or ammonia. Also, to surface modify a sulfonyl membrane to convert the surface layer facing the cathode to the corresponding carboxylic material. Typical of this method is that described in U.S. Pat. No. 4,151,053, incorporated herein by reference.

The manufacture of thin sheets of the copolymeric materials of the instant invention in the past have been as expressed previously very tedious. The copolymeric material would be melted and calendered of the required thickness. In cases where reinforcing fabric was included with the sheet of membrane, the problems were further increased because the flowability of the copolymeric material at processing temperatures is limited and if the temperatures are raised further to improve the flowability, the polymeric material degrades. In almost all cases, the membrane materials must be reinforced so as to be sufficiently rugged to be economically advantageous in the uses envisioned. Typical of the problems encountered in preparing fabric reinforced sheet membranes can be found in U.S. Pat. No. 4,147,844. In the case of membranes deposited directly on the cathode or material which is directly on the cathode, further processing problems existed using melt techniques. Among the most persistent problem was poor adhesion of the membrane to the cathode surface. Typical of such prior art methods are those disclosed in U.S. Pat. No. 4,036,728 wherein diaphragm type electrolytic cells are converted to membrane electrolytic cells by depositing membrane on the cathode.

BRIEF SUMMARY OF THE INVENTION

Highly fluorinated cation exchange materials containing sulfonyl and carboxyl groups have been widely used in various industries. For example, such materials are used in chlor-alkali membrane cells and as acid catalysts. The highly fluorinated nature of these products has resulted in numerous processing problems since at the equivalent weight range in which such materials have been found to be useful as cation exchange materials the polymers were insoluble prior to the instant invention. By the process of the instant invention it has been found that the precursor resin to the cation exchange materials, that is, the copolymeric material containing sulfonyl fluoride, carbonyl fluoride, sulfonate ester, or carboxylate esters, can be dissolved in a solvent selected from the group consisting of low molecular weight polymers of perhalogenated alkyl ethers, low molecular weight polymers of perhalogenated alkyls, and perfluoro kerosenes, each of said solvents having boiling points between about 200° C. and 350° C. This precursor to the polymer containing ion exchange sites is referred to in the instant specification as the intermediate polymer. The dissolution of such intermediate polymer with high solvent loading readily permits many easily controlled processing techniques which result in more uniform end products formed from the intermediate polymer. For example, such solvent technique can employ spraying, dipping, rolling, painting and other coating techniques to produce uniform coatings of the intermediate polymer directly on foraminous cathodes or on matting material upon the cathode surface. Likewise, laminar products containing different equivalent weight intermediate polymer can be utilized as well as laminar products containing different intermediate resins and/or different cation exchange groups.

DETAILED DESCRIPTION OF THE INVENTION

Copolymeric ion exchange materials are well known in the art. Typically, these are highly fluorinated resins containing sulfonic acid or carboxylic acid groups or salts thereof attached to the copolymer. The useful range of equivalent weights, i.e., the weight of of resin/-mole of cation exchange groups in said resin, found to be useful are generally in the range of 1000 to 1600. These highly fluorinated materials in this equivalent weight range however are extremely difficult to process since the highly fluorinated nature makes them somewhat akin to polytetrafluoroethylene which requires special processing techniques. The cation exchange materials are not processed in the ionic form, but rather in the precursor form referred to in this application as the intermediate polymer. By intermediate polymer is meant the form of the copolymeric resin before it is converted to the ionic form. In the intermediate form, the sulfonyl portion of the molecule is in the sulfonyl fluoride or sulfonate ester form. If the carboxyl group is present, it can be in the carbonyl fluoride or carboxylate ester form. This precursor or intermediate resin is thermoplastic or melt processable and, thus, prior art techniques for shaping and forming sheets or other shaped forms involved hot pressing, calendering, molding or the like techniques to bond individual particles of intermediate polymer together to result in the desired form or shape of material. The degree of freedom in such processing is extremely limited sense the resulting material is quite heat sensitive and overheating in the forming step can, in fact, decrease the utility of the resulting cation exchange material.

Further difficulties in processing the materials of the prior art are encountered when it is desired to reinforce intermediate polymer with a fabric or the like. Typical such methods are described in U.S. Pat. No. 3,925,135.

By the discovery of the solvent for the intermediate polymer in the present invention, such processing difficulties are overcome and coated cathodes of any size or laminates on cathodes of any size can be readily made without highly specialized equipment, merely by casting, painting, dipping, or other standard coating techniques, followed by removal of the solvent by heat, vacuum and/or solvent stripping techniques. The dimensions of the so-produced film on the cathode can be closely controlled.

The intermediate polymer which serves as the precursor to the polymer containing ion exchange sites is prepared from monomers which are fluorine-substituted vinyl compounds. The polymers include those made from at least two monomers with at least one of the monomers coming from each of the two groups described below. The frist group comprises fluorinated vinyl compounds such as vinyl fluoride, hexafluoropropylene, vinylidene fluoride, trifluoroethylene, chlorotrifluoroethylene, perfluoro (alkyl vinyl ether), tetrafluoroethylene and mixtures thereof.

The second group includes monomers containing or capable of being converted to cation exchange materials containing pendant sulfonic acid, carboxylic acid and less desirably phosphoric acid groups. Esters or salts which are capable of forming the same ion exchange groups can also be utilized. Furthermore, the monomers of the second group can also contain a functional group in which an ion exchange group can easily be introduced and would include such groups as oxyacids, salts, or esters of carbon, nitrogen, silicon, phosphorus, sulfur, chlorine, arsenic, selenium, or tellurium.

One of the preferred family of monomers in the second group is the sulfonyl containing monomers containing the precursor $-SO_2F$ or $-SO_3$ alkyl. One example of such a comonomer is $CF_2{=}CFSO_2F$. Additional examples can be represented by the generic formula $CF_2{=}CFR_fSO_2F$ wherein $R_f$ is a bifunctional perfluorinated radical comprising 2 to 8 carbon atoms. The particular chemical content or structure of the radical linking the sulfonyl group to the copolymer chain is not critical and may have fluorine, chlorine or hydrogen atoms attached to the carbon atom to which is attached the sulfonyl group, although the carbon atom must have at least one fluorine atom attached. If the sulfonyl group is attached directly to the chain, the carbon in the chain to which it is attached must have a fluorine atom attached to it. The $R_f$ radical of the formula above can be either branched or unbranched, i.e., straight chained, and can have one or more ether linkages. It is preferred that the vinyl radical in this group of sulfonyl fluoride containing comonomers be joined to the $R_f$ group through an ether linkage, i.e., that the comonomer be of the formula $CF_2{=}CFOR_fSO_2F$. Illustrative of such sulfonyl fluoride containing comonomers $$CF_2{=}CFOCF_2CF_2SO_2F,\ CF_2{=}CFOCF_2\underset{\underset{CF_3}{|}}{C}FOCF_2CF_2SO_2F,$$

$$CF_2{=}CFOCF_2\underset{\underset{CF_3}{|}}{C}FOCF_2\underset{\underset{CF_3}{|}}{C}FOCF_2CF_2SO_2F,$$

$$CF_2{=}CFCF_2CF_2SO_2F,$$

$$\text{and } CF_2{=}CFOCF_2\underset{\underset{\underset{\underset{CF_3}{|}}{O}}{\underset{|}{CF_2}}}{\underset{|}{C}}FOCF_2CF_2SO_2F$$

The most preferred sulfonyl fluoride containing comonomer is perfluoro(3,6-dioxa-4-methyl-7-octenesulfonyl fluoride).

$$CF_2{=}CFOCF_2\underset{\underset{CF_3}{|}}{C}FOCF_2CF_2SO_2F.$$

The sulfonyl contaning monomers are disclosed in such references as U.S. Pat. Nos. 3,282,875 to Connolly et al. and 3,041,317 to Gibbs et al, 3,560,568 to Resnick and 3,718,627 to Grot.

The preferred intermediate copolymers are perfluorocarbon, i.e., perfluorinated, although others can be utilized as long as there is a fluorine atom attached to the carbon atom which is attached to the sulfonyl group of the polymer. The most preferred copolymer is a copolymer of tetrafluoroethylene and perfluoro(3,6-dioxa-4-methyl-7-octenesulfonyl fluoride) which comprises 10 to 60 percent, preferably 25 to 40 percent by weight of the latter.

The intermediate copolymer is prepared by general polymerization techniques developed for homo- and copolymerizations of fluorinated ethylenes, particularly those employed for tetrafluoroethylene which are described in the literature. Nonaqueous techniques for preparing the copolymers of the present invention include that of U.S. Pat. No. 3,041,317, to Gibbs et al. by the polymerization of the major monomer therein, such as tetrafluoroethyene, and a fluorinated ethylene containing sulfonyl fluoride in the presence of a free radical initiator, preferably a perfluorocarbon peroxide or azo compound, at a temperature in the range of 0°-200° C. and at pressures in the range 1-200 or more atmospheres. The nonaqueous polymerization may, if desired, be carried out in the presence of a fluorinated solvent. Suitable fluorinated solvents are inert, liquid, perfluorinated hydrocarbons, such as perfluoromethylcyclohexane, perfluorodimethylcyclobutane, 1, 1, 2-trichlorotrifluoroethane, perfluorooctane, perfluorobenzene, and the like.

Aqueous techniques for preparing the intermediate copolymer include contacting the monomers with an aqueous medium containing a free-radical initiator to obtain a slurry of polymer particles in non-water-wet or granular form, as disclosed in U.S. Pat. No. 2,393,967 to Brubaker, contacting the monomers with an aqueous medium containing both a free-radical initiator and a telogenically inactive dispersing agent, to obtain an aqueous colloidal dispersion of polymer particles, and coagulating the dispersion, as disclosed, for example, in U.S. Pat. Nos. 2,559,752 to Berry and 2,593,583 to Lontz.

Transformation of the intermediate polymer to a polymer containing ion exchange sites is by conversion of the sulfonyl groups ($—SO_2F$ or $—SO_3$ alkyl) to $—SO_3X$ where X is hydrogen or alkali metal. The converted polymer is a fluorine containing polymer with a plurality of sulfonate groups present as ion exchange sites. These ion exchange sites will be contained in side chains of the polymer and will be attached to individual carbon atoms to which are attached at least one fluorine atom. The conversion of the sulfonyl groups in the intermediate polymer to ion exchange sites may be in accordance with known techniques in the prior art, e.g., U.S. Pat. Nos. 3,770,567 to Grot and 3,784,399 to Grot.

Another preferred family of monomers of the second group is the carboxyl containing monomers of the structure referred to previously in discussing the sulfonyl monomers wherein the carboxyl group replaces the sulfonyl group. Often, the final copolymer contains one less carbon atom than the corresponding sulfonyl copolymer due to conversion process such as discussed in U.S. Pat. No. 4,151,053 (See Column 7, lines 37-64). Particularly preferred monomers in this group include $$CF_2{=}CF—O—CF_2CF(CF_3)O(CF_2)_2COOCH_3$$

and $$CF_2{=}CF—O—CF_2(CF_3)OCF_2COOCH_3$$

Such monomers can be made in accordance with the teachings found in U.S. Pat. No. 4,151,053 or Japanese Published Patent Application 52(1977) 38486. Methods of copolymerization are likewise disclosed therein.

The preferred soluble copolymer of the present invention is one which comprises 10-60%, more preferably 25-40% by weight of the second monomer so as to yield equivalent weights in the range of 1000 to 1600 or most preferably in the range of 1000-1300.

The soluble fluoropolymer of the instant invention is also characterized by the presence of the carboxyl and/or sulfonyl groups represented by the formula:

$$—OCF_2CF_2X \text{ and/or}$$

$$—OCF_2CF_2Y—O—YCF_2CF_2O—$$

wherein X is sulfonyl fluoride, carbonyl fluoride, sulfonate ester, or carboxylate ester and Y is sulfonyl ($—SO_2—$) or carbonyl ($—CO—$).

The aforedescribed intermediate polymer can be dissolved only by use of the specific solvents disclosed hereinafter.

The solvents useful in the present invention are low molecular weight polymers of perhalogenated alkyls and/or perhalogenated alkylethers having boiling points in the range of 200° C. to 350° C. Particularly preferred are the oligomers or telomers of chlorotrifluoroethylene, $—(CF_2—CFCl)_n—$ wherein n is 5 to 15 having boiling points between about 200° C. and 350° C., and perfluorokerosenes having boiling points between about 200° C. and 350° C.

Typical perhalogenated alkyl solvents available commercially are the "Halocarbon Oils" sold by Halocarbon Products Corp., Hackensack, New Jersey. Particularly preferred of these saturated low molecular weight polymers of chlorotrifluoroethylene are Halocarbon Oil 11-14 and Halocarbon Oil 11-21. Similar solvents useful in the instant invention are the FLUOROLUBES® sold by Hooker Chemical Corporation, Niagara Falls, New York. Preferred among the FLUOROLUBES® are Fluorolube FS-5 and MO-10.

Ugine Kuhlmann of Paris, France also offers low molecular weight polymers of chlorotrifluoroethylene in their Voltalef® oil line. A typical solvent from this company useful in the present invention would be Voltalef® 10-S.

One specific embodiment for the instant invention is in the conversion of diaphragm-type cells to membrane cells. The membrane separator for a standard diaphragm electrolytic cell electrode assembly and the method for forming such a membrane will overcome many of the disadvantages of the prior art forms listed above and yield the benefits of the use of a membrane in an electrolytic cell without the substantial capital cost associated heretofore with the conversion of a diaphragm electrolytic cell to a membrane electrolytic cell. Most of these diaphragm electrolytic cells in use today are of two general types. Both consist of an outer steel shell either cylindrical or rectangular which supports a cathode of perforated iron plate or woven iron screen inside of the shell, generally referred to as a foraminous electrode element. This constitutes the cathode assembly. The actual cathode surfaces are generally lined with a layer of asbestos either in the form of paper wrapped around it or vacuum deposited fibers. The type of cathode assembly for which the present invention is especially useful is that known as the Diamond Shamrock Cell wherein the cathode assembly consists of a rectangular steel shell housing with an inner assembly of lateral rows of vertically flattened wire-screen tubes, upon which the diaphragm has been deposited by suction from a cell liquor suspension of asbestos fibers.

Since these foraminous electrode assemblies generally have a high porosity it is necessary to reduce the porosity by vacuuming some type of matting material onto the foraminous electrode surface before applying a membrane material. The matting material may be an asbestos support made from chrysotile asbestos fibers mixed with 5% (by weight) fluorinated ethylene propylene copolymer particles, or any other material which will form a sufficient mat upon the foraminous electrode. Another example would be a cellulosic material. Alternatively, sheets of material such as filter paper could be wrapped around the electrode tube. It is believed that the exact nature of the matting material is not of great significance since it is generally of a temporary nature for the purpose of supporting the polymeric materials to form a film upon the foraminous electrode. It is believed that any depositable fiber with suitable thermal properties will serve as an adequate support structure, inertness to chlorine cell environments not being necessary. Since the thickness of the support structure affects the cell potential it is desirable to obtain the thinnest matting structure consistent with the purpose of substantially reducing the porosity of the foraminous electrode material. One way of building a matting which is often used in industry is to suspend the matting material in a fluid medium and in the case of the asbestos fibers usually the cell liquor. The foraminous electrode material may then be suspended into the slurry of matting material and a vacuum pulled to the inside of the foraminous electrode material such that the fibers of the matting material will be drawn onto the surface of the foraminous electrode. This support structure will then provide a uniform surface on which the dissolved intermediate polymer can be applied. Once the solution of dissolved intermediate polymer has been applied and the solvent stripped therefrom, the support structure is no longer necessary and the film performs like a membrane on the cathode structure. The matting structure itself must have a low enough porosity to retain the dissolved intermediate polymer on the surface without being pulled to the interior portions of the matting material. This is easily controlled by controlling the degree of polymer loading or viscosity of the treating solution. In fact, the intermediate polymer in the dissolved state can be maintained at a high viscosity which minimizes the fineness required of the matting material, as compared to when the melt fabrication techniques of the prior art are utilized. Another preferred method is to paint the surface of the matting material, strip the solvent therefrom and repeat as often as needed to obtain a continuous sheet of intermediate polymer on the surface of the matting material. In some cases where the openings in the cathode are small enough, no matting material is needed. Likewise, in other cases where a reinforcing fabric is utilized, often the openings in the reinforcing fabric are small enough to overcome the need for a matting material when practicing the instant invention.

Once a thin and uniform film is formed on the surface of the cathode or the matting material thereon, which is substantially impermeable to hydraulic flow, the film may then be hydrolyzed into the infusible ion exchange form. Hydrolyzing or saponifying of the intermediate polymer is a fairly simple procedure for the conversion of the sulfonyl form, or carboxyl form to the ionic form. This may be accomplished by soaking the coated cathode in a sodium hydroxide solution, sodium hydroxide in dimethyl sulfoxide solution, potassium hydroxide solution, or potassium hydroxide in dimethyl sulfoxide solution. Any of these treatments appear to work equally well although different temperatures and times are required to accomplish the hydrolysis. Once this step has been accomplished, the electrode is then ready for use in a standard diaphragm electrolytic cell. The conditions of the cell should be altered to operate the cell as a membrane electrolytic cell.

The resultant membrane electrolytic cell will yield a high current density, a lower sodium chloride concentration in the resultant sodium hydroxide solution compared to that of standard diaphragm cell, a higher resultant sodium hydroxide concentration, good utilization of existing cell space, longer life for cell and a lower potential. Thus, those skilled in the art will recognize the advantages of the present invention to the chlorine and caustic industry.

To this point, the deposited membrane has been described as a single type material. However, those skilled in the art will realize that the membrane coating on the cathode can be built up of various layers of membrane material having different equivalent weights or different chemical structures, as for example, separate layers of carboxylic and sulfonate type membrane. Such membranes are made by merely laying down a continuous surface of the desired membrane material and stripping the solvent therefrom. Generally, it is preferred to have the carboxylic side of an asymmetric carboxylic/sulfonate membrane facing the cathode and to have the higher of the equivalent weight materials likewise facing the cathodes. This minimizes back migration of hydroxyl ions and such layer facing and touching the cathode can be very thin so as to minimize resistance across the membrane. In addition, membrane contemplated by the instant invention may be aminated, as with ammonia, monoamines or diamines. Normally such modification is on the cathodic side of the membrane and this also minimizes back migration of hydroxyl ions, improving efficiency of the cell. Preferred amination is with ethylene diamine, n-propylamine or ethyl amine and such amination is applied to the cathodic side of the membrane through the cathode after deposition of the membrane material on the cathode.

Typical examples of the solution coatings of the instant invention are as follows;

EXAMPLE 1

Two 2.5" diameter circular cathodes fabricated from 6-mesh steel screens were fastened tightly together by means of a $\frac{3}{8}\times\frac{1}{4}$" diameter stud threaded into nuts welded flush into their centers. The assembled pair of screens was dipped into a solution of 61 grams of 1200 equivalent weight intermediate resin copolymer of tetrafluoroethylene and perfluoro(3,6-dioxa-4-methyl-7-octenesulfonyl fluoride) in 549 grams Fluorolube FS-5, at 245° C. with a dwell time of less than 5 seconds. The coated screens were placed in a vapor phase extractor and extracted with methylene chloride for 24 hours. They were then air-dried followed by drying in an oven with the temperature being slowly raised from 80° to 160° C. over a 7-hour period. The pair of cathodes was separated, giving two electrodes each coated on only one side with intermediate resin, the screen openings being completely bridged with transparent resin. The cathode side of the better of the two was exposed to ethylene diamine under conditions such that a sulfonamide depth of 1 mil resulted, and the membrane was hydrolyzed with sodium hydroxide in aqueous dimethyl sulfoxide. A perforated ¼" diameter×6" long steel shaft was used to replace the center stud and the coated cathode was installed in a standard 3 square inch diaphragm-type laboratory electrolysis cell. When operated in a membrane mode for the electrolysis of aqueous sodium chloride, the cell produced sodium hydroxide at 368 grams per liter concentration with a current efficiency of 80 percent at a cell potential of 3.48 volts (2 asi current density, 90° C.).

EXAMPLE 2

To the center of a circular 2.25" diameter cathode made from 6-mesh steel screen was welded a ½" long threaded ¼" diameter stub. This stub was designed to be attached by means of collar to a threaded ¼"×6" steel rod and thus enable the cathode to be demountable. The cathode screen was placed in a special cylindrical funnel with an internal diameter slightly greater than the diameter of the cathode and having a capacity of about 200 ml. A thin cellulose web was deposited on the electrode screen by gravity draining a suspension of 0.5 gram of pulped Whatman #41 filter paper in about 200 ml of water through the steel grid. After pressing for 30 minutes with a rubber dam at 20" vacuum, the coated cathode was dried at 100° C. for 4 hours, giving a cellulose web density of about 0.15 g/in$^2$ of cathode surface. The back of the cathode was then blanked off by covering it with a 2.25" diameter washer secured by a nut to the center stub and separated from the mesh by a gasket formed from ⅛" Gore-Tex® (W. L. Gore Associates) expanded Teflon joint sealant around the external perimeter. This assembly was dipped in the intermediate resin solution (copolymer of tetrafluoroethylene and $CF_2{=}CFOCF_2CF(CF_3)OCF_2CF_2SO_2F$ of 1200 equivalent weight) at a solution temperature of 245° C. and 10-second dwell time. After cooling, the steel back was removed, the cathode soaked in methylene chloride for 6 hours and air dried overnight. Finally, it was dried 14 hours at 100° C. followed by a programmed temperature increase to 140° C. over a 4-hour period. Based on a weight increase of 1.09 grams, the intermediate resin thickness was about 7 mils. After ethylene diamine treatment and hydrolysis as in Example 1, the deposited membrane was tested in the laboratory electrolysis cell of Example 1. It produced, under standard conditions (2 asi current density, 90° C.), 377 grams per liter sodium hydroxide with a current efficiency of 90.2 percent and a cell potential of 3.52 volts.

EXAMPLE 3

Example 2 was repeated using a cathode coated with chopped Kevlar® fiber (E. I. duPont de Nemours brand of aramide polymer) with a web density of 0.1 g/in$^2$ and an intermediate resin thickness of 11 mils. After ethylene diamine treatment and hydrolysis, it produced 339 grams per liter sodium hydroxide at a current efficiency of 75.9 percent and a cell potential of 4.75 volts under standard conditions (2 asi currenty density, 90° C.).

EXAMPLE 4

Example 2 was repeated using a cathode coated with Teflon fibrids at a web density of 0.24 g/in$^2$ and and intermediate resin thickness of 6 mils. After ethylene diamine treatment and hydrolysis, it produced 397 grams per liter sodium hydroxide at a current efficiency of 80.9 percent and a cell potential of 4.77 volts under standard conditions (2 asi current density, 90° C.).

EXAMPLE 5

A cellulose-covered cathode prepared as in Example 2 was dipped at 225° C. for 10 sec in the carboxy intermediate resin solution (copolymer of tetrafluoroethylene and $CF_2{=}CFOCF_2CF(CF_3)OCF_2CF_2CO_2CH_3$ of 1050 equivalent weight). After drying in a mechanical convection oven at 225° C. for 15 minutes, it was redipped (5-second dwell time) and dried as before. This deposited membrane had a thickness of about 12 mils. After saponification, it produced 305 grams per liter sodium hydroxide at a current efficiency of 90.2 percent and a cell potential of 3.67 volts under standard conditions (2 asi current density, 90° C.).

EXAMPLE 6

Example 2 was repeated using a cathode coated with glass fibers (prepared by dispersing 0.25 gram Gelman glass fiber filters in 200 ml of water with a Waring blender) at a web density of 0.03 g/in$^2$. The solution used in this case was prepared by dissolving 91.5 grams, 1200 equivalent weight intermediate resin (copolymer of tetrafluoroethylene and perfluoro (3,6-dioxa-4-methyl-7-octenesulfonyl fluoride) in 467 grams of Halocarbon Oil 11-14 mixed with 52 grams Halocarbon Oil 11-21. The intermediate resin thickness was 6 mils. After ethylene diamine treatment and hydrolysis, it produced 375 grams per liter sodium hydroxide at at a current efficiency of 84.8 percent and a cell potential of 4.74 volts under standard conditions (2 asi current density, 90° C.).

EXAMPLE 7

A cathode with cellulose precoat (web density of about 0.3 g/in$^2$) was prepared as in Example 2 and dipped in the carboxy intermediate resin solution, used in Example 5 above, at 226° C. for 10 seconds. After drying at 225° C. for 15 minutes in a mechanical convection oven, the cathode was redipped in intermediate resin solution of Example 6. The resulting laminate was extracted, dried and hydrolyzed as in Example 2 (total resin thickness prior to hydrolysis was about 10 mils). Under standard conditions (2 asi current density, 90° C.), in the electrolysis cell of Example 1, it produced 414 grams per liter sodium hydroxide at 81.4 percent current efficiency at a cell potential of 3.91 volts.

EXAMPLE 8

Example 7 was repeated using as a substrate a 71/29(wt) mixture of glass and carbon fibers (web density about 0.1 g/in$^2$). This laminate gave 440 grams per liter sodium hydroxide at a current efficiency of 79.5 percent with a cell potential of 5.96 volts (2 asi current density, 90° C.) when tested in the electrolysis cell of Example 1.

EXAMPLE 9

Example 2 was repeated using ¼" long chopped rayon fiber as a substrate (web density about 0.15 g/in$^2$) and the intermediate resin solution of Example 6 above. After ethylene diamine treatment and hydrolysis, the deposited membrane was tested in the electrolysis cell of Example 1. Under standard conditions (2 asi current density, 90° C.), it produced 380 grams per liter sodium hydroxide with a current efficiency of 78.8 percent and a cell potential of 5.02 volts.

The solvents of the instant invention are capable of dissolving completely depending on equivalent weight the intermediate polymer up to about 30 weight percent when the intermediate polymer is in the sulfonyl fluoride, carbonyl fluoride, sulfonate ester, or carboxyl ester form. In making up the solutions, normally the appropriate amount of intermediate polymer and solvent are mixed and heated to temperatures below the boiling point of the solvent. Typically, the heating is usually done to temperatures in the range of 220° C. to 260° C. Using these temperatures, total dissolution of the intermediate polymer takes place anywhere up to 24 hours, depending upon equivalent weight temperature, degree of polymer loading and agitation. Once in solution, the intermediate polymer may be applied to cathode to form membrane coatings of any possible dimension and returned to the solid state merely by stripping off the solvent Fabric reinforcement such as Teflon fabrics of various weave, degrees of openness and surface preparations can also be encapsulated in the same manner resulting in a stress-free, reinforced membrane of closely controlled uniform thickness. Also, such reinforcing fabrics can be dipped into these hot solutions of dissolved intermediate polymer. Multiple dippings can be used if thicker membranes are desired. The coated reinforcing cloth on the foraminous cathode may then be dipped into methylene chloride or other given solvent for the preferred chlorotrifluoroethylene telomer solvent, and after a period of time, removed and allowed to dry in air and then placed in an oven for thermal treatment. The thermal treatment is for the purpose of removing any remaining methylene chloride and we have found that treatment at 100° C. for four hours followed by a slow temperature rise over approximately a 3-hour period to 220° C. is completely satisfactory. The previously discussed extraction method using methylene chloride is most useful in the systems wherein the intermediate polymer is in the sulfonyl form. If the intermediate polymer is in the carboxyl ester form, no extraction is necessary and the resulting film or reinforced membrane may be cured directly by heating at 225° C. for a very short time, as for example, one to fifteen minutes. Prior to the heating, the film or reinforced membrane is cloudy, due to the inclusion of solvent. However, after the heating, the film cloudiness disappears.

Asymmetric membranes may also be prepared by the above-described techniques, such as by multiple dipping. Thus, various equivalent weight laminates and asymmetric carboxylic/sulfonate or sulfonamide laminates may be prepared. In most cases, it is preferred to use multiple dipping or coating techniques to ensure against pinholes in the film or reinforced membranes. When utilizing a multiple coating technique, purification of the surface between coatings may be utilized if desired. Purification of the surface can be made using Freon-type solvents, but such purification is not necessary.

The preferred loading of the solutions of the instant invention are those that contain from 1 to 30 weight percent intermediate polymer, as these are easily used in most forming techniques.

What is claimed is:

1. A method for forming a membrane over a standard diaphragm cell foraminous cathode comprising the steps of: dissolving in a solvent a polymeric material polymerized from at least two monomers, one said monomer consisting essentially of a fluorinated vinyl compound and said other monomer consisting essentially of at least one monomer of the structure

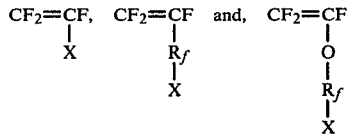

wherein $R_f$ is a bifunctional perfluorinated radical containing from two to eight carbon atoms, which carbon atoms may be interrupted by one or more oxygen atoms and X is selected from the group consisting of sulfonyl fluoride, carbonyl fluoride, sulfonate ester, and carboxylate ester, said solvent for said polymeric material being at least one selected from the group consisting of low molecular weight polymers of perhalogenated alkylethers, low molecular weight polymers of perhalogenated alkyls and perfluorokerosenes, each having boiling points between about 200° C. and 350° C.; applying said dissolved polymeric material to said cathode surface; and thereafter stripping said solvent therefrom to resolidify said polymeric material in the shaped form.

2. The method as stated in claim 1 wherein said other monomer is $CF_2{=}CFOCF_2CF(CF_3)O(CF_2)_2SO_2X$ and X is fluorine or lower alkoxy.

3. The method as stated in claim 1 wherein said other monomer is $CF_2{=}CFOCF_2CF(CF_3)O(CF_2)_2CO_2R$ and R is lower alkyl.

4. The method as stated in claim 1 wherein said other monomer is $CF_2{=}CFOCF_2CF(CF_3)OCF_2CO_2R$ and R is lower alkyl.

5. The method as stated in claims 1, 2, 3, or 4 wherein said fluorinated vinyl compound is tetrafluoroethylene.

6. A method as stated in claim 1 wherein said dissolved polymeric material is applied to a matting material which has been previously applied to the cathode surface.

7. A method as stated in claim 1 wherein the dissolved polymeric material is applied to a reinforcing fabric which has first been applied to the surface of the cathode.

* * * * *

UNITED STATES PATENT AND TRADEMARK OFFICE

CERTIFICATE OF CORRECTION

PATENT NO. : 4,272,560

DATED : June 9, 1981

INVENTOR(S) : Stanley K. Baczek and G. Howard McCain

It is certified that error appears in the above–identified patent and that said Letters Patent are hereby corrected as shown below:

Column 5, line 65 should read "$CF_2=CF-O-CF_2CF(CF_3)OCF_2COOCH_3$"

Signed and Sealed this

*Eighth* Day of *September 1981*

[SEAL]

*Attest:*

GERALD J. MOSSINGHOFF

*Attesting Officer*

*Commissioner of Patents and Trademarks*